United States Patent [19]

Franke et al.

[11] Patent Number: 4,624,504

[45] Date of Patent: Nov. 25, 1986

[54] METHOD OF EXCAVATING OVERBURDEN IN SURFACE MINING OPERATIONS

[75] Inventors: Rüdiger Franke, Mettmann; Aby Weiss, Monheim; Hans Goergen, Cologne; Christian Niemann-Delius, Aachen, all of Fed. Rep. of Germany; Frank Kay, Houston, Tex.

[73] Assignee: Mannesmann Aktiengesellschaft, Dusseldorf, Fed. Rep. of Germany

[21] Appl. No.: 583,706

[22] Filed: Feb. 27, 1984

[30] Foreign Application Priority Data

Feb. 26, 1983 [DE] Fed. Rep. of Germany ..... 3306828

[51] Int. Cl.[4] ..... E21C 41/00

[52] U.S. Cl. ..... 299/18; 299/19

[58] Field of Search ..... 299/18, 19, 64, 7; 37/195

[56] References Cited

U.S. PATENT DOCUMENTS 4,290,651 9/1981 Files et al. ..... 299/19 X 4,453,770 6/1984 Dalrymple et al. ..... 299/19 X

*Primary Examiner*—Stephen J. Novosad

*Assistant Examiner*—Michael A. Goodwin

*Attorney, Agent, or Firm*—Toren, McGeady, Stanger, Goldberg & Kiel

[57] ABSTRACT

In the removal of the overburden prior to surface mining of minerals in an elongated pit, one or more first excavating machines remove the overburden along one elongated part of the pit and direct the removed material via a cross-pit transporter across the pit where it is deposited outwardly from and along the opposite side, called the dump side. At least one other excavating machine travels along the remaining elongated part of the pit at a level not higher than the level of the cross-pit transporter and removes the overburden to the same dump side of the pit. The excavating machines moving along the elongated part of the pit operate independently of one another. When the cross-pit transporter and the second excavating machine operating in the remaining elongated part of the pit on the same level, meet while moving in opposite directions, the second excavating machine moves across the pit out of the path of the cross-pit transporter and the transporter is moved past the second excavating machine. The excavating machine is then returned to its previous position and the overburden excavation is continued. If necessary, temporary changes in the travel direction of the transporter and its associated excavating machines can be effected, continuing the excavation operation until the conditions for the passing maneuver have been accomplished.

6 Claims, 5 Drawing Figures

METHOD OF EXCAVATING OVERBURDEN IN SURFACE MINING OPERATIONS

SUMMARY OF THE INVENTION

The present invention is directed to a method of uncovering minerals in surface mining, particularly in elongated open pits where the overburden has a great depth. The overburden is stripped by means of excavating machines operating at one or more levels on one side of the pit hereinafter called the high wall side which direct a part of the overburden to a cross-pit transporter which conveys the overburden across the pit and dumps it along the opposite side of the pit, hereinafter called the dump side. The deeper layers of overburden are removed by at least one other excavating machine, such as a dragline, which travels at a level not higher than the cross-pit transporter and deposits them directly on the dump side of the pit.

The direct transport of the overburden along the shortest possible distance across the open pit is the most economical method of uncovering the mineral layers in surface mining. The known solutions involve the direct depositing of the overburden by draglines, however, such equipment is limited by the distance at which it can dump the material. Another possibility is the use of scrapers, but they are limited to short distances and small amounts transported, because of the high energy consumption. There are other known transport bridges which span the pit and are supported on both of its sides. Such bridges require relatively expensive tracks, particularly along the dump side. Finally, combined systems consisting of excavating machines and disposal machines are known in various embodiments including the use of an excavating machine and a discharge belt conveyor which is freely suspended across the open pit. In some cases, additional excavating machines are utilized in uncovering the minerals in parallel operations.

The combination of machines just mentioned can be divided into two categories, that is, where passing of the conveyor can only be effected over excavating machines operating at lower levels, their use is restricted by the limited height of the overburden to be removed. Another category permits the passing of the conveyor by excavating units which operate at a lower level as well as those which operate at the same level, and these combinations can be used for greater overburden depths.

Based on this introduction, the present invention is directed to a cross-pit transporter for use in surface mining where the overburden is relatively great and wherein several excavating machines are used located at different levels. Generally, draglines are used at the lower levels and a combination of excavating machines and a cross-pit transporter is used at the higher levels. For problem-free operation it is required that the machines operating at different levels, including the machine for mining the mineral itself, can operate independently from one another. The structural pecularities of cross-pit transporters are significant for such open mining operations.

In one known arrangement, the cross-pit transporter is of a great structural height and its possible applications are restricted in respect to maximum depth of the overburden to be removed.

In another known arrangement the passage of the transporter and an excavating machine operating at the same level can be effected by swinging the long discharge boom on the transporter through about 90°. Such a movement involves significant interference with the sequence of operations, because all of the machines operate in a "tandem operation" and must be exactly tuned to one another in their conveying capacities to avoid passing of the machines along the bench in the pit. In one known method, the machines which work together, that is, the cross-pit transporter and an excavating machine, move together to one end of the bench where, after the cross-pit transporter has been pivoted, the machines reverse direction in a relatively complicated manner and in a time consuming operation. The efficiency of such systems is limited because of unavoidable time and productivity losses.

Based on the knowledge that the greatest time and productivity losses occur when the different pieces of equipment block the passage of one another along the bench in the pit, the present invention has the primary object of providing a method of excavating overburden which reduces to a minimum the time and productivity losses when the different pieces of equipment must pass one another and, thus, significantly improves the economy of the excavation method.

In accordance with the present invention, when the cross-pit transporter and an excavating machine, usually a dragline, moving along the same bench level meet one another, the excavating machine leaves its travel path and moves to the slope of the upper layer of overburden and waits in a position displaced from the path of the cross-pit transporter until the transporter has moved to a location where it does not block the excavating machine. Subsequently, the excavating machine is returned to the location it left and continues its operation. Such an operation makes it unnecessary to pivot the boom of the cross-pit transporter as is presently known, and the "tandem operation" presently used is not required.

In a particular method embodying the present invention when the cross-pit transporter and an excavating machine (dragline) travelling in opposite directions and at the same level encounter one another, the direction of travel of the cross-pit transporter is reversed and, along with the excavating machines which cooperate with it, provide a space in the overburden into which the excavating machine can move to permit the passage of the cross-pit transporter. With the excavating machine in its displaced position, the cross-pit transporter again reverses its direction of travel to continue its normal operation and then the excavating machine returns to its original position to continue normal excavating operations.

This method of operation allows the cross-pit transporter and the excavating machine (dragline) to move past one another even when the width of the bench on which they are travelling is relatively narrow, since the required width for passing is specifically provided at the location where the passing movement is to take place. While the excavating machines cooperating with the cross-pit transporter dig out the space for the excavating machines to be moved, the excavating machine (dragline) to be moved continues its operation without interruption in the lower body of the overburden, so that no production losses occur during such time period. When the space is being prepared to receive the excavating machine (dragline), since the cross-pit transporter and the excavating machine are moving in the same direction, there is no interference in the operation of such equipment. When a space of sufficient size has been excavated to receive the excavating machine, the machine to be displaced discontinues its operation in the lower body of the overburden for a short period of time and moves into the excavated space. The cross-pit transporter then resumes its original travel direction, passes the displaced excavating machine and, after such passage, the displaced machine returns to the position for the continuation of its normal operation. Similarly, the excavating machines cooperating with the cross-pit transporter return to their excavating positions which they had left for excavating the space for the machine and operation is continued in the same manner as before the passing maneuver.

As a result of the ability of the cross-pit transporter and the excavating machine (dragline) to travel independently of one another in the same direction and in opposite directions, it is possible to prepare an excavation schedule so that the encounter of the two pieces of equipment on the same bench level can be kept to a minimum, whereby resulting production losses play an insignificant role in the overall use of the method. Further, it is advantageous to use two excavating machines (draglines) each operating at a different level, with the method being characterized by the following steps:

(a) Two excavating machines (draglines) are employed each excavating one-half of a bench in the length direction;
(b) each excavating machine (dragline) travels alternatively along the same level as the cross-pit transporter and along a lower level;
(c) the cross-pit transporter travels from one end of the bench to the other; and
(d) all of the machines travel at approximately the same average speed.

Since one of the two excavating machines (draglines) are always located at a level below the cross-pit transporter whereby no interference in the movement of the passing cross-pit transporter is possible, an appropriate adjustment in the movements of the machines assures a limited number of meetings will take place between the cross-pit transporter and the excavating machine travelling on the same level so that it is necessary to effect a passing of the transporter and the excavating machine in the manner mentioned above.

It has been found to be particularly advantageous if the excavating machine (dragline) moving along the same level as the cross-pit transporter removes the overburden from the center to one end of the bench, while the other excavating machine located at a level below the transporter removes the overburden from the end of the bench to the center.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1A:
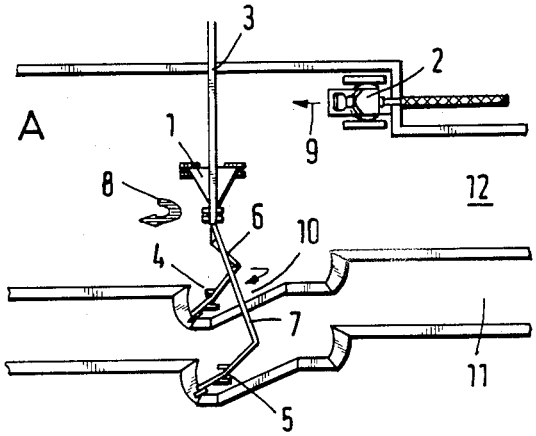
FIGS. 1*a*, 1*b*, 1*c* each illustrate a different step of three steps of the method embodying the present invention for effecting the passing of the cross-pit transporter and an excavating machine (dragline)
Figure 1B:
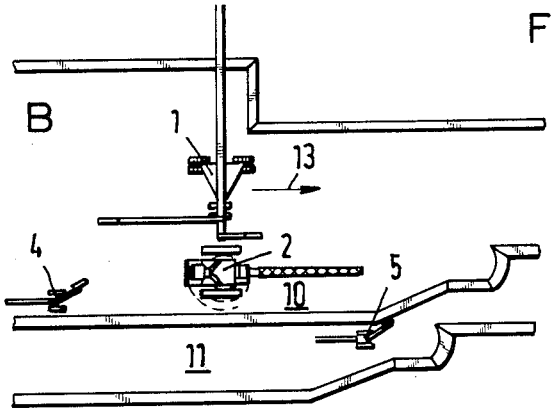
Figure 1C:
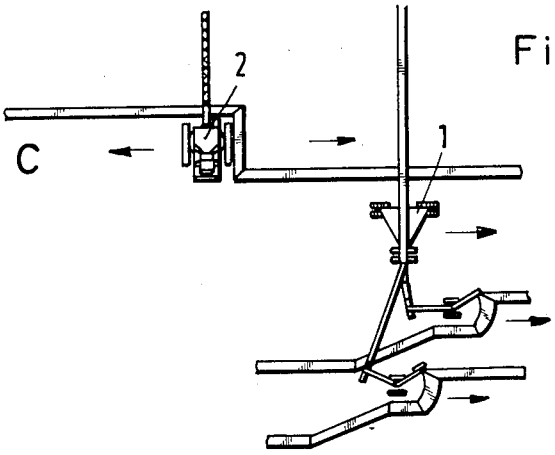

FIGS. 1*a*, 1*b* and 1*c* each show a different step A (FIG. 1*a*), B (FIG. 1*b*) and C (FIG. 1*c*), in the method of removing the overburden in an open pit mining operation. These three figures show a top view of the highwall side of the pit in which a cross-pit transporter 1 and an excavating machine (dragline) 2 travel along the same level 12. The cross-pit transporter receives the over-burden excavated from the upper layers of the pit and transports the overburden on a boom 3 to the opposite side of the pit, not shown. The overburden carried by the cross-pit transporter, is removed in two stages by the excavating machines 4, 5 which direct the excavated material onto the transporter. The excavating machine 4 operates on the same level 12 as the cross-pit transporter 1, while the other excavating machine 5 is located on the level 11 spaced upwardly from the excavating machine 4. Each of the excavating machines 4, 5 directs the overburden onto an intermediate conveyor belt 6, 7, respectively, and then onto the conveyor belt running along the boom 3 of the cross-pit transporter 1.

In step A illustrated in FIG. 1*a*, the cross-pit transporter 1 and the excavating machine 2 meet after travelling in opposite directions along the bench or level 12 in the pit. As shown in FIG. 1*a* the excavating machine 2 has travelled from the right to the left while the cross-pit transporter has travelled left to right. In step A (FIG. 1*a*), as shown by the arrow 8, the cross-pit transporter 1 reverses its travel direction so that, temporarily, it moves in front of the excavating machine 2, whereby the excavating machine can continue to operate in the direction of the arrow 9 without any interference. With the reversal in the travel direction, the excavating machines 4, 5 begin to excavate a space 10 from the overburden layer or level 11, that is, the excavating machine 4 excavates the space 10, the excavating machine 5 excavates a similar space at the upper level. Accordingly, the space 10 is located on the level 12 on which the cross-pit transporter 1 and the excavating machine 2 are travelling.

As soon as the space 10 is sufficiently large, the excavating machine 2 travels across the bench at level 12 into the space 10 as shown in step B in FIG. 1*b*, and the cross-pit transporter 1 reverses its direction and travels in the original direction as indicated by the arrow 13. In this step, the cross-pit transporter can move along the level 12 without departing from its path of movement since the excavating machine sits in the space 10 between the end of the transporter and the slope leading up to the level 11. As displayed in step C in FIG. 1, after the cross-pit transporter 1 has moved in the direction of the arrow 13 out of the range of the excavating machine 2, the excavating machine 2 can return to its previous excavating position and resume the temporarily interrupted excavation operation. The cross-pit transporter and the excavating machine 2 continue to travel in the direction of the arrows away from one another, note FIG. 1C, as before the passing maneuver.

Figure 2A:
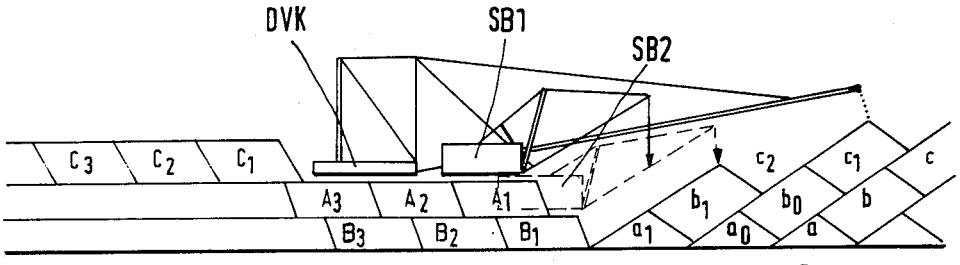
FIG. 2*a* is a schematic cross-sectional view of an open pit illustrating the cross-pit transporter and two excavating machines operating at a different level.
Figure 2B:
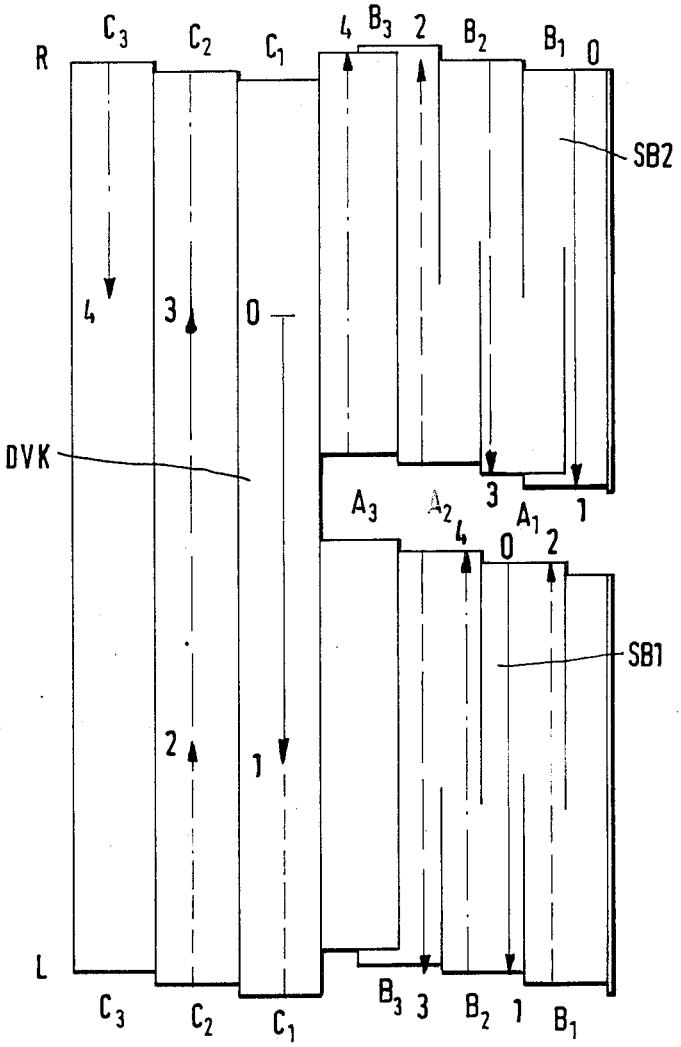
FIG. 2*b* is a schematic plan view of the open pit in FIG. 2*a* displaying the paths of travel of the cross-pit transporter and the two excavating machines (draglines) during the excavating operation.

In FIG. 2 a particularly advantageous embodiment of the method of the present invention is illustrated schematically. FIG. 2*b* displays a top or plan view of the highwall side of the pit where the overburden is excavated. In FIG. 2*a*, a schematic cross-section through the overburden in the open pit is shown. In FIG. 2, the cross-pit transporter combination is identified by DVK, a dragline located on the same level as the transporter is identified as SB1 and a second dragline travelling on a lower level and shown in broken lines is identified by SB2. The excavating machines forming a part of the combination DVK are not shown in FIGS. 2*a* or 2*b*, only the cross-pit transporter is shown in FIG. 2*a* and indicated by the reference characters DVK in FIG. 2*b*. The upper layer of the overburden is designated by the letter C with the numerals added denoting a partial cross-section of the overburden layer which is excavated in one path of travel of the cross-pit transporter along the bench in the open pit. Two lower layers of the overburden are indicated by A and B and these layers are excavated and dumped by the draglines SB1 and SB2, respectively. On the right-hand side of FIG. 2*a* the excavated overburden is shown in the dumped locations designated by the same, but lower case letters. In FIG. 2*b*, each of the two draglines SB1 and SB2 operate in approximately one-half of the open pit in its long direction, e.g., SB1 in the left half and SB2 in the right half. The ends of the pit are designated by the letters L for left and R for right. The partial cross-sections A1, A2 and A3 of the overburden are always mined from the center toward the end of the bench and the deeper partial cross-sections B1, B2, B3 are excavated from the end to the center. To describe the sequence of the operation a starting situation is supposed: the right half of $A_1$ has been excavated so that SB2 can operate on the layer $B_1$; as part of $C_1$ has also been excavated. The starting point for each of the pieces of equipment is marked by O with the cross-pit transporter combination DVK excavating the partial cross-section $C_1$, the dragline SB1 excavating the section $A_1$ and the dragline SB2 excavating the section B. The further characteristic points in time in the excavation operation are marked by successive numbers and define the position of the individual pieces of equipment when the draglines SB1 and SB2 have reached one end of the half bench. An important feature of the method is that all of the pieces of equipment move at the same average speed. The solid line sections "0–1" indicate that in the same time period the cross-pit transporter combination DVK moves from "0" to "1" excavating a part of the overburden C1, the excavating machine SB1 moves from "0" to "1" excavating A1 on the left half of the pit and the excavating machine SB2 moves from "0" to "1" excavating B1 in the right-hand half of the pit. The dashed line sections "1–2" indicate in the next time period combination DVK moves from "1" to "2" excavating parts of the layer C1 and C2, the excavating machine SB1 moves from "1" to "2" excavating the left half of the overburden layer B1 and the excavating machine SB2 moves from "1" to "2" excavating the right half of overburden layer A2. Similarly, the corresponding movements of the combintion DVK and the excavating machines SB1 and SB2 follow the lines "2"–"3" and "3"–"4".

DVK moves on the layer A from 0 to 1, the dragline SB1 excavating the layer $A_1$ left travels on the same level from 0 to 1 and the dragline SB2 travels also from 0 to 1 on the layer B excavating the section $B_1$ right. When SB2 reaches the center of the open pit, the dragline SB1 reaches the end of the pit. During the partial cross-sections $A_1$ left and $B_1$ right of the bench have been excavated. The dragline SB1 leaves the level A moving downwards to the level B and excavates the partial cross-section $B_1$ left travelling to the center of the open pit at 2. There is no interference with the passage of the cross-pit transporter combination DVK also travelling from 1 to 2. The dragline SB2 moves upwards to the level A then excavating the section $A_2$ right from the center of the pit to the right end R to the position 2 and does not afford any interference with the combination DVK. As the cross-pit transporter combination DVK continues its movement toward 3, the dragline SB1 reverses direction and moves along the level A over the cross-sectional portion A2 left toward 3 at the left-end L of the pit as viewed in the lower part of FIG. 2. During this movement to the end of the bench at 3, the first meeting occurs between the dragline SB1 and the combination DVK and the passing maneuver described in FIG. 1 takes place. During this phase there is no interference between the dragline SB2 and the cross-pit transporter combination DVK because the dragline SB2 is located again on the lower level B moving over the cross-sectional portion B2. Since the cross-pit transporter combination DVK has now moved into the right half of the open pit, there is no possibility of a meeting with the dragline SB1.

When the dragline SB2 changes its direction of travel from the center to the end, that is, from position 3 to position 4, it moves over the level A along the cross-sectional part A3 where the dragline moves into the path of the oncoming cross-pit transporter combination DVK and the passing maneuver illustrated in FIG. 2 is again performed.

It is apparent that during the excavation of the partial cross-sections B1, B2, B3 and A1, A2 and A3, only two meetings between the dragline SB1 and SB2 with the cross-pit transporter combination DVK takes place which require the passing maneuver as shown in FIG. 1. Due to the short down time in the excavating operation, the production losses are kept to a minimum and the method of the invention can be very economical.

While specific embodiments of the invention have been shown and described in detail to illustrate the application of the inventive principles, it will be understood that the invention may be embodied otherwise without departing from such principles.

We claim:

1. In a method of exposing minerals in surface mining operations such as where large depths of overburden are present over the minerals and where the mining operation is carried out by means of excavating machines operating at one or more levels in an elongated pit having a highwall side and a dump side spaced laterally from one another comprising the steps of excavating the overburden and depositing the excavated overburden along the dump side using a cross-pit transporter and using at least a first excavating machine for excavating one or more upper layers of overburden on the highwall side and using the cross-pit transporter for conveying the excavated overburden across the pit and onto the dump side, and using a second excavating machine travelling at a level not higher than the level of the cross-pit transporter and excavating one or more overburden layers deeper than excavated by the combination of the at least one first excavating machine and the cross-pit transporter and directly depositing the excavated overburden from the second excavating machine onto the dump side, wherein the improvement comprises when the cross-pit transporter in a first excavating position and the second excavating machine in a second excavating position travelling on the same level within the pit meet and interfere with the continued movement of one another with the cross-pit transporter travel path located between the second excavating unit travel path and the highwall side, moving the second excavating machine from the second excavating position thereof across the pit to a third waiting position in an area between the highwall side and the cross-pit transporter travel path, moving the cross-pit transporter in the elongated direction of the pit past the second excavating machine to a position where it no longer interferes with the movement of the second excavating machine, returning the second excavating machine to the second excavating position where previously the second excavating machine and cross-pit transporter had interfered with the movement of one another and continuing the overburden excavating operations, with said cross-pit transporter and said second excavating machine travelling on the same level in opposite directions and meeting with the cross-pit transporter in the first position and the second excavating machine in the second position, reversing the travel direction of said cross-pit transporter together with the first excavating machines and excavating a space in the highwall side bordering the level on which the second excavating machine and the cross-pit transporter are travelling and then moving the second excavating machine from the second position into the excavated space into the third waiting position and reversing the direction of the cross-pit transporter to its original direction of travel and moving the cross-pit transporter past the second excavating machine in the third waiting position, and then returning the second excavating machine from the excavated space to the second excavating position thereof.

2. Method, according to claim 1, including using two first excavating machines for supplying the overburden to the cross-pit transporter with one of the first excavating machines located on the same level with the cross-pit transporter and the other first excavating machine located also at the same level or at a level above the cross-pit transporter.

3. Method, as set forth in claim 1, wherein the second excavating machine is a dragline.

4. In a method of exposing minerals in surface mining operations such as where large depths of overburden are present over the minerals and where the mining operation is carried out in an elongated pit having a highwall side and a dump side spaced laterally from one another and each of the banks extending in the elongated direction of the pit, comprising the steps of excavating the overburden and depositing the excavated overburden along the dump side using a cross-pit transporter extending transversely of the elongated direction and using at least a first excavating machine having an excavating position for excavating one or more layers of overburden on the highwall side and directing the excavated overburden to the cross-pit transporter for conveying the excavated overburden outwardly of the dump side, and using a second excavating machine travelling at a level not higher than the level of the cross-pit transporter and excavating one or more overburden layers deeper than excavated by the combination of the at least one first excavating machine and the cross-pit transporter and directly depositing the excavated overburden from the second excavating machine onto the dump side, wherein the improvement comprises excavating the deeper layers of overburden in the open pit using two second excavating machines, using each second excavating machine for excavating approximately half of the pit extending in the elongated direction, so that each second excavating machine operates alternatively at the level of the cross-pit transporter and at a lower level, moving the cross-pit transporter over the whole length of the pit in the elongated direction alternatively from one end of the pit to the other and moving the two second excavating machines each between a different end of the pit and the center of the pit in the elongated direction over only approximately half of the pit length, and moving the two second excavating machines the first excavating machine and cross-pit transporter at approximately the same average speed.

5. Method, as set forth in claim 4, including the step of carrying out the excavation of the deeper overburden layers performed by the two second excavating machines by moving each of the second excavating machine when located on the same level as the cross-pit transporter from the center of the bench each to a different end of the bench and moving the same second excavating machines when located at a level below the level of the cross-pit transporter each from the different end of the bench to the center.

6. Method, as set forth in claim 4, wherein the second excavating machines are draglines.

* * * * *